United States Patent [19]

Chong

[11] Patent Number: 4,925,042

[45] Date of Patent: May 15, 1990

[54] INDEPENDENT INFANT BOTTLE FEEDING ENSEMBLE

[76] Inventor: Ray Chong, 52 D'Arcy Street, Toronto, Canada, M5J 1J7

[21] Appl. No.: 233,258

[22] Filed: Jul. 27, 1988

Related U.S. Application Data

[63] Continuation-in-part of Ser. No. 43,425, Apr. 28, 1987, abandoned.

[51] Int. Cl.[5] ..... A61J 9/00; A61J 9/06; A61J 11/04

[52] U.S. Cl. ..... 215/11.1; 215/101; 215/228; 215/100 A; 220/94 R; 224/148

[58] Field of Search ..... 215/11.1–11.6, 215/43, 425, 101, 328, 100 R, 100 A, 222, 229; 604/77; D24/46, 47; 248/103; 224/142; 220/90.2, 94 R

[56] References Cited

U.S. PATENT DOCUMENTS

| | | | |
|---|---|---|---|
| 224,557 | 2/1880 | Potter | 215/11.1 |
| D. 225,039 | 10/1972 | Sauritis | D24/46 |
| 280,656 | 7/1883 | Morris | 215/11.1 |
| 329,103 | 10/1885 | Tumbleson | 215/11.1 |
| 460,360 | 9/1891 | Coward | 215/11.1 |
| 624,974 | 5/1899 | Poruis | 215/11 R |
| 1,037,051 | 8/1912 | Ramsey | 215/101 X |
| 1,208,922 | 12/1916 | Dawkins | 604/77 |
| 2,760,664 | 8/1956 | D'Amico et al. | 215/11.1 |
| 3,065,873 | 11/1962 | Plate | 215/11.1 |
| 3,076,574 | 2/1963 | Woodbury, Jr. | 215/11.1 |
| 3,171,571 | 3/1965 | Daniels | 215/11.1 X |
| 4,301,934 | 11/1981 | Forestal | 215/11 D |
| 4,463,859 | 8/1984 | Greene | 215/11.1 |

FOREIGN PATENT DOCUMENTS

| | | | |
|---|---|---|---|
| 2555 | of 1872 | United Kingdom | 215/11.1 |
| 2067416 | 7/1981 | United Kingdom | 215/11.4 |
| 2170410 | 8/1986 | United Kingdom | 215/11.1 |

*Primary Examiner*—Sue A. Weaver

[57] ABSTRACT

A versatile feeding device comprising a receptacle having a lip, a lid complementary with the lip and having a first aperture formed therein, a tubular handle supporting a nipple and of such a rigidity as to support the receptacle in different positions during feeding, the tubular handle providing a passage for fluid communication between the first aperture and the nipple, with a mounting flange on the lip of the bottle for holding the tubular handle for movement relative to the lid about a transverse axis and a guide portion with an abutment surface for coaxially receiving the tubular handle and mounted on the bottle lip to hold the tubular handle in a second position for limited movement about the transverse axis. To eliminate the need for anyone to hold the receptacle, a clamp is provided on an outer surface of the receptacle, for attachment of the receptacle to an anchored object. ALso disclosed is a kit for use on a feeding device.

10 Claims, 2 Drawing Sheets

INDEPENDENT INFANT BOTTLE FEEDING ENSEMBLE

This disclosure claims subject matter disclosed in and is a continuation-in-part of prior copending application, Ser. No. 07/043,425 filed Apr. 28, 1987; presently having a status of Abandonment.

The present invention relates to feeding devices. Conventional bottle feeders with centre-mounted nipples are flush-mounted onto bottles with a cap-like device. These feeders possess many disadvantages such as requiring direct supervision; difficulty in the propping up of the bottle; being most effective when hand held; the bottle being too large for the baby's hand; requiring the baby's head to tilt; etc. Other references suggest a lengthy, flexible tube between the nipple and the bottle. Some suggest the use of brackets or clamps for bottle support. The shortcomings of these inventions include: difficulty in cleaning the inside of lengthy, flexible tubes; flexible tubes are flimsy, thereby making bottle manipulation difficult during feedings; flexible tubes allow for no bottle support; brackets or clamps lack portability and convenience since they attach the bottle to stationary objects such as furniture (i.e. crib). Morever, any dip in the tube below the baby's mouth hinders fluid flow through to the nipple because of gravity. Flexible tubes also have a tendency to crease or fold.

The present invention called the INDEPENDENT INFANT BOTTLE FEEDING ENSEMBLE seeks to overcome the foregoing disadvantages by providing the following advantages; it is not necessary for the bottle to be hand held; the bottle can be attached by a clamp to portable objects for propping (i.e. cushion, stuffed animals, apparel of supervisor); the handle which is tubular separates the nipple from the bottle for better weight distribution away from the baby's mouth; the baby can be fed while sitting straight; the baby's head tilt does not have to correspond to the inclination of the bottle; there is steadier fluid flow through the handle to the nipple based on the Bernoulli Principle; the movable handle allows for the baby's head to move and the bottle to move without having the nipple slip out; the handle between the nipple and bottle provides a means for the baby to hold the bottle up; it also reduces the obstruction of vines for the baby and supervisor; and it enhances the gross motor development and spatial awareness of the baby by enabling the baby to manipulate the nipple resting above the handle. The embodiments of this invention with the exception of the clamp on the bottle are detachable to facilitate cleansing.

In general, the present invention comprises of a rigid pipe to be referred hereon as a handle, which possesses the advantages of flexible tubes without their shortcomings. For instance, the bottle of the invention does not have to be held over the baby's head to be used, and also has the added advantage of the handle remaining stationary in one of its positions to enable infants to grasp the handle with one hand for holding the bottle up during feedings. Prior art exhibitions flexible tubes are designed to have the bottle resting over the head of the baby, providing no easy method for the bottle to be held up by the baby.

The clamp of the present invention can attach the bottle to light, portable objects which can be adjusted continuously by the supervisor or baby without the bottle becoming detached or having to be reattached.

This clamp feature in the "bottle ensemble" permits portability in a variety of feeding situations, unlike the other inventions with hooks and clamps which are limited and restrictive in use. For example, during bottle feedings with the infant in the supervisor's arm, attachment of the bottle to the supervisor's shirt will free the hand which normally would hold the bottle, thereby, permitting the supervisor to attend to other tasks. Likewise, this usage can be applied in many situations such as while shopping or being fed in the car. The handle supporting the nipple to the bottle allows the baby to be held further away from the supervisor's body. It also accommodates the head movements of the baby without nipple slippage out of the mouth when the handle is in a position of transverse movement.

The flexible sleeve portion of the mounting flange made of elastic material which joins the handle to the bottle lid does not fold or crease when the handle is inserted.

Furthermore, the circular base of the sleeve portion is recessed below the cap abutment flange of the mounting flange to facilitate the handle's movement in a radial direction. This resembles the movement of a flexible tube thereby permitting the handle to be made of rigid material, and also enables the sleeve made of elastic material to fold as it rolls up or unfold as it rolls down against the handle when pressure is applied accordingly to the desired position of the invention.

The INDEPENDENT INFANT BOTTLE FEEDING ENSEMBLE has two modes of operation for feeding. The first position of the invention provides a flexible junction at the base which connects the handle to the central axis of the bottle lid to allow the nipple resting on the top of the handle to move freely up or down, and in a radial direction which provides allowances for the infant's head movement while sucking on the nipple, and also for some accommodation of bottle movement when it is attached by a clasp to an object (i.e. apparel of supervisor, stuffed animal, pillow etc.)

The second position of the invention provides limited transverse movement of the handle in the central axis of the bottle lid to enable the baby to hold the bottle up by the handle during feedings while either sitting or lying down.

The two positions of the invention are easily interchangeable. The first position is attained when the bottom end of the handle in the sleeve portion is resting above the guide portion which is situated between the base of the mounting flange and the lip of the bottle. The second position is easily attained by pushing the handle down through the central axis of the bottle lid into a rigid guide portion with an abutment surface situated below the mounting flange. A return to the first position is manageable by pulling the handle out of the guide portion and its abutment surface.

Furthermore, none of the references suggest the use of a handle which is movable between two positions to provide a handle for feeding which, in one position, may be bent away from the central axis of the receptacle, while, in another position, the handle may be limited from such movement to enable the user to hold the filled bottle up by the handle.

SUMMARY OF THE INVENTION

The present invention relates to an ensemble for the independent bottle feeding of infants, in particular, to the handle which is in the shape of a hollow tube whereof one end engages onto a conventional nipple, whilst the other end is engageable to a mounting flange on the bottle top wherein it provides a junction of flexibility if desired between the nipple, and bottle, and a coil spring-type clamp embodied along the bottle side for attachment to objects such as cushions, stuffed animals and supervisor's clothing. During dependent and independent feedings, the handle, in one position, has transverse movement to allow the bottle to be angled differently from the nipple assembly supported above the handle. The flexible mounting flange engaged onto the bottom end of the handle would enable the bottle to be tilted for a steadier fluid flow into the nipple to reduce the intake of excess air by the baby when nursing. Furthermore, the flexible junction eliminates the need for the baby's head to be tilted with respect to the bottle's inclination, and also allows for lateral movement of the nipple without having the nipple slip out of the baby's mouth when nursing from a bottle which is fixed at a particular position. Another position of the handle inherent in the invention enables the baby to hold a filled bottle up during feeding when the handle portion is movable into a guide portion with an abutment surface, thereby, restricting transverse movement relative to the lid of the bottle.

BRIEF DESCRIPTION OF THE DRAWINGS

A preferred embodiment of the present invention will now be described by way of example only as illustrated in the appended drawings, in which.

DESCRIPTION OF THE EMBODIMENT

Figure 1:
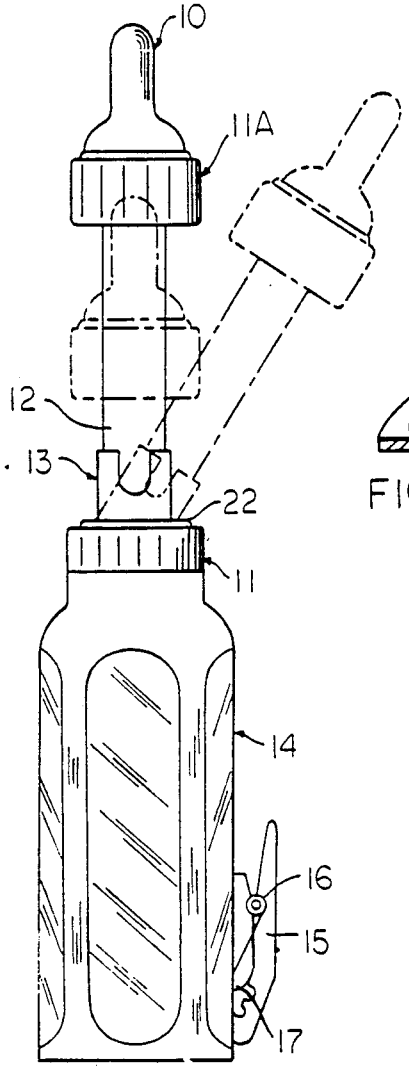
FIG. 1 is a side elevational view of a feeding device.
Figure 2:
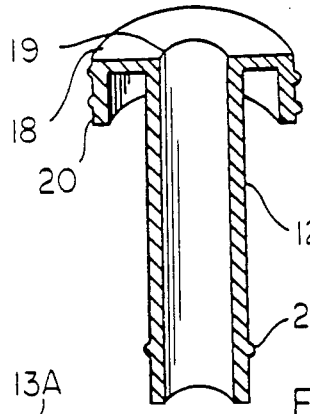
FIG. 2 is a cross-sectional view of one component of the device illustrated in FIG. 1.

With reference to the drawings, FIGS. 1–7 illustrate the invention throughout, in which similar reference characters denote similar elements throughout the several views.

Commencing with FIG. 1, a nipple 10 which is a conventional type is secured in place by a twist cap 11*a*, likewise that twists over it onto a handle section 12 of which the body 12*a* can be inserted into a sleeve 13*a* in the form of a mounting flange made of elastic material (i.e. latex rubber). The flexible mounting flange 13 is held in a twist cap 11 which in turn is disposed on the lip of a bottle 14. The bottle has a spring-loaded clamp 15 resting on its base 17, along a sideface 30 of the bottle 14 for attachment to an appropriate object during feedings.

The handle 12 has a body 12*a* in the shape of a pipe of a rigid construction which terminates at a disc portion 18 with a right-angled threaded side wall 20 that is an integral form of the handle 12. The body 12*a* also has a rim 21 near its lower end. The rigid flat disc 18 provides an opening 19 and base for the conventional nipple 10 held in place by the twist cap 11*a*. The diameter of the openings 19 of the handle 12 is equal in size to the inner circumference of the handle 12 while the outer circumference is lesser than an orifice 29 defined in the twist cap 11. This not only permits a clear passageway for fluid flow from the bottle 14 through to the adjoining nipple 10, but also allows the handle 12 to pass through the mouth 29 in order to restrict the movement of the handle 12, as will be described. The objects of the handle embodiment are to separate the nipple from the bottle to reduce bottle obstructive views, to provide a steadier fluid flow into the nipple based on the Bernoulli Principle, to redistribute the weight of the bottle away from the baby's mouth, to maintain a mobile horizontal axis, and to provide a means for a baby's hand to hold the bottle up in one position during a particular mode of operation in feeding.

Figure 3:
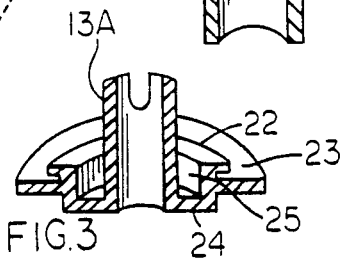
FIG. 3 is a cross-sectional view of another component of the device illustrated in FIG. 1.
Figure 4:
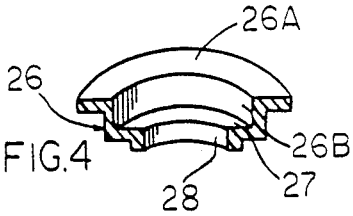
FIG. 4 is a cross-sectional view of yet another component of the device illustrated in FIG. 1.
Figure 5:
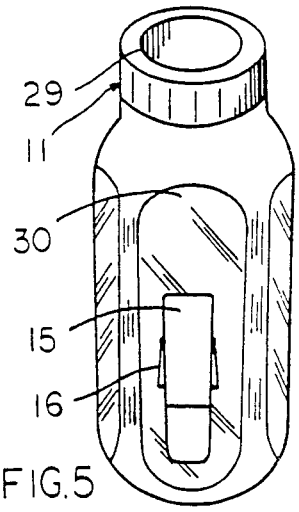
FIG. 5 is a frontal view portion of the device illustrated in FIG. 1.

The flexible mounting flange 13 is illustrated in further detail in FIG. 3 and is made of elastic material that can stretch over the inserted handle 12 and its protruding rim 21. The flexible mounting flange 13 has a sleeve 13*a* and a cap abutment flange 22. The sleeve 13*a* is narrower in circumference than the handle 12 and has a recessed circular base 24 that is below a seat flange 23. A cap abutment flange 22 is also provided to engage the twist cap at the periphery of the orifice 29. The seat flange 23 fits snugly into the twist cap 11, with sleeve 13*a* and flange 22 fitting through the bottle cap opening 29. The sleeve 13*a* thus, aids in securing the handle 12 in position to the bottle 14 for fluid flow to the nipple 10; and also provides a junction of flexibility in which the wall 25 and the base 24 are movable to accommodate movement of nipple 10 and handle 12 about a horizontal axis relative to the bottle 14 when the handle 12 is inserted into the sleeve 13*a* and not beyond the base 24 of the flexible mounting flange 13. This is better seen in FIGS. 1 and 6 where movement of the handle 12 in one position within the flexible mounting flange 13 is represented in chain-dot lines to illustrate one mode of feeding.

Figure 7:
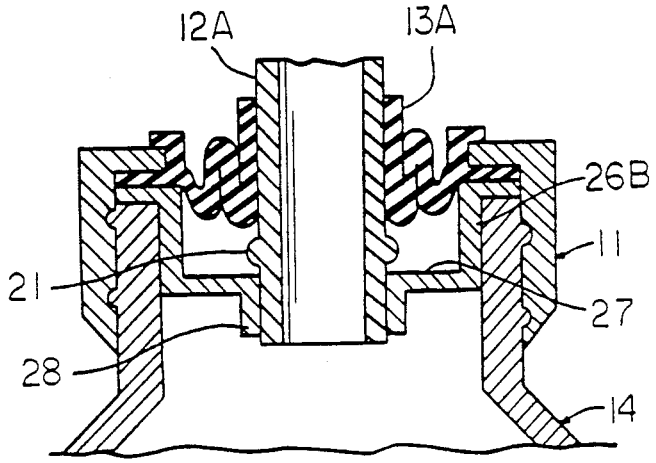
FIG. 7 is a longitudinal sectional view of the feeding device illustrated in FIG. 1 in a second position.

In the event a flexible junction is not required or transverse movement of the handle 12 within the flexible member 22–25 is not required, the handle 12 can be pushed down further into a cylindrical guide portion 26 with an abutment surface 28 which is situated within the bottle cap 11 between the flexible mount 13 and the lip of the bottle 14; where the seat rim 23 of flexible mount 13 is resting above the seat rim 26*a* of the guide portion 26, and where the base 24 is accommodated above the lower level seat rim 27 respectively. Integral with the lower level seat rim 27 is an abutment surface 28 to limit transverse movement of the handle 12 when it enters telescopically through the flexible mounting flange 13 wherein its sleeve member 13*a* rolls against the handle 12 in an opposite direction upwards, all the while simultaneously securing the handle 12 as it is being pushed down into the abutment surface 28. The rim 21 of the handle 12 will allow the necessary amount of structure for proper abutment with the surface 28 to enable a filled bottle to be propped up by the handle 12. This other mode of operation for feeding with the handle 12 being in a second position is shown in FIG. 7 wherein the mounting flange 13 is folded back on itself between the pipe 12*a* and the bottom rim wall 26*b*. This position corresponds to that illustrated in dashed lines in FIG. 1 where the handle 12 is displaced toward the receptacle in order to engage the pipe 12*a* with the abutment surface 28. The folded configuration of the mounting flange 13 is achieved by a rolling action away from the pipe 12*a* as the handle 12 is displaced to its second position which would enable the baby to hold a filled bottle up with one hand by gripping the handle 12. Conversely, the resiliency of the sleeve 13*a* allows it to snap back against the pipe 12*a* when pulled away from the zone of the wall 26*b*, simultaneously causing the handle 12 to pop back to its first position.

Figure 6:
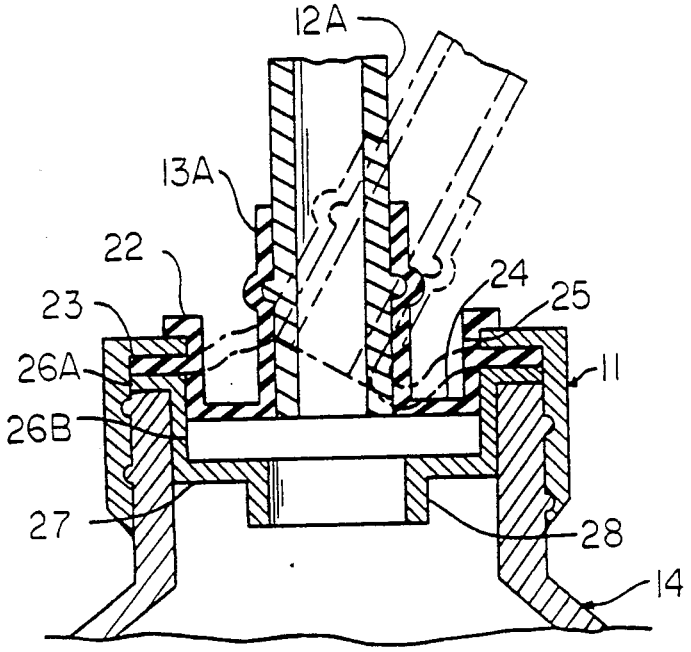
FIG. 6 is a longitudinal sectional view of the feeding device illustrated in FIG. 1 in one position.

The base 24 of the flexible mounting flange 13 is designed to rest above the lower level seat rim 27 of the guide portion with a margin of space as illustrated in FIG. 6 for two reasons: first, to avoid obstruction of the handle 12 with the abutment surface 28 when it is moving in a transverse direction in one position; second, to provide space for the base 24 and sleeve 13*a* of the flexible mounting flange 13 to stretch before the sleeve 13*a* and part of the base 24 can achieve its rolling action against the handle 12 in its second position.

Clamp 15 is secured in place by a coil spring 16 onto a base 17 that is attached along the face 30 of bottle 14. The clamp 15 is shorter than the bottle length, narrower than the width of its side, and having the front of the clamp 15 facing the bottom and stopping short of the base of the bottle 14 for horizontally or vertically sloped attachment of the bottle ensemble to objects such as a blanket, stuffed animals and clothing of the supervisor to enable such person freedom of one hand when holding the infant in the other arm, or when desired propping of the bottle is required.

It is to be understood that the form of the invention herein shown and described is to be taken as a preferred example of the same, and that various changes in the shape, size, materials and arrangements of parts may be resorted to without departing from the spirit of the invention or scope of the appended claims.

I claim:

1. A feeding device comprising a receptable having a lip, a lid complementary with said lip and having a first aperture formed therein, a tubular handle including means for supporting a nipple and said handle being of such a rigidity as to constitute means for supporting said receptacle in different positions during feeding, said handle providing a passage for fluid communication between said first aperture and said nipple, coupling means for coupling said handle with said lid and constituting means to permit movement of said handle relative to said lid at a first position wherein said handle is movable relative to said lid about a transverse axis therethrough, and further including means, in coaxial alignment with said coupling means, for restricting said handle to a second position wherein the movement about said transverse axis is limited.

2. A feeding device as defined in claim 1 wherein said means for supporting a nipple is disposed on one end of said handle and includes an integrally attached base plate with a second aperture centrally located therein which is aligned with said passage, said base plate arranged to receive said nipple.

3. A feeding device as defined in claim 2 wherein said handle has another end which is engaged with said coupling means to join said passage with said receptacle.

4. A feeding device as defined in claim 3 wherein said coupling means is a flexible mounting member including a sleeve portion dimensioned for telescoping connection over said other end of said handle and a base flange radially outwardly extending from said sleeve portion to lie below said lid, and be disposed between said lid and said bottle lip with the sleeve portion extending through said first aperture.

5. A feeding device as defined in claim 4 wherein said sleeve portion includes a body portion and a cap abutment flange extending radially from said body portion, said cap abutment flange being coupled with and spaced axially above said base flange so as to secure the lid between said cap abutment flange and said base flange.

6. A feeding device as defined in claim 5 wherein said means for restricting movement of said handle includes a guide portion having a seating flange for seating on said bottle lip and a cylindrical abutment surface coaxially aligned with said first aperture and dimensioned to abut said handle near said other end when said handle is in said second position, said guide portion providing means to restrict the movement about said transverse axis when said handle is in said second position.

7. A feeding device as defined in claim 6 wherein said guide portion includes a cylindrical section having an inner surface defining said cylindrical abutment surface, said inner surface being dimensioned for telescoping engagement with said other end of said handle therethrough when in said second position.

8. A feeding device as defined in claim 6 wherein a clamp is provided near a lower edge of an outer surface of said receptacle, so as to attach said receptacle to an anchored object for independent feeding.

9. A feeding device comprising a receptacle having a lip, a lid complementary with said lip and having a first aperture formed therein, a tubular handle including means supporting a nipple and said handle being of such a rigidity as to constitute means for supporting said receptacle in different positions during feeding, said handle providing a passage for fluid communication between said first aperture and said nipple, means mounted above the lip of the bottle for holding the handle for movement relative to the lid about a transverse axis, and further means for coaxially receiving said handle and mounted above the bottle lip to hold the handle in a second position for limited movement.

10. A kit for use on a feeding device of the type having a receptacle with a mouth on which a nipple is mounted by way of a lid, with an aperture therein comprising:

a tubular handle including means for coupling on one end with said lid and further including means to support said nipple at another end and of a passage in register with said aperture for fluid communication between said receptacle and said nipple, said coupling means for coupling said one end of said handle with said lid and further including means to permit movement of said handle relative to said lid at a first position wherein said handle is movable relative to said lid about a transverse axis therethrough, and further including means, in coaxial alignment with said coupling means, for restricting said handle to a second position wherein the movement about said transverse axis is limited.

* * * * *